United States Patent [19]

Soucy

[11] 4,245,717

[45] Jan. 20, 1981

[54] FIRE ESCAPE LADDER

[76] Inventor: Donald P. Soucy, 4862 W. Braddock Rd. No. 20, Alexandria, Va. 22311

[21] Appl. No.: 69,052

[22] Filed: Aug. 23, 1979

[51] Int. Cl.[3] ..... E06C 1/383

[52] U.S. Cl. ..... 182/96; 182/160

[58] Field of Search ..... 182/95, 96, 160, 159, 182/161, 162

[56] References Cited

U.S. PATENT DOCUMENTS

| | | | |
|---|---|---|---|
| 453,929 | 6/1891 | Heister | 182/160 |
| 1,140,281 | 5/1915 | Otto | 182/160 |
| 1,401,526 | 12/1921 | Saussure | 182/160 |

FOREIGN PATENT DOCUMENTS

| | | | |
|---|---|---|---|
| 641751 | 5/1962 | Canada | 182/160 |
| 2015735 | 4/1970 | Fed. Rep. of Germany | 182/96 |

*Primary Examiner*—Reinaldo P. Machado

*Attorney, Agent, or Firm*—Lane, Aitken, Ziems, Kice & Kananen

[57] ABSTRACT

A lightweight collapsible ladder which may be secured to a structure. The ladder includes two parallel uprights which are connected to one another by a plurality of pivotally mounted rungs, and is movable from a closed position in which the uprights abut one another to an open position in which the uprights are apart and the rungs are horizontal. Support devices are provided for supporting the ladder in its open position. A locking device is mounted on the ladder for holding the ladder in its closed position. The rungs are arranged in two adjacent vertical planes, every other rung located in one of the vertical planes and alternate rungs positioned in the other vertical plane.

12 Claims, 5 Drawing Figures

FIRE ESCAPE LADDER

BACKGROUND OF THE INVENTION

This invention relates to a foldable or collapsible ladder adapted for use on homes, apartments, schools, hospitals, office buildings and any other structures where people are likely to be more than one floor above ground level. More particularly, this invention relates to a lightweight collapsible ladder having an inner upright secured to the wall of the structure and a parallel outer upright connected to the inner upright by pivotally mounted rungs, and movable from a closed position, in which the outer upright abuts the inner upright, downwardly and outwardly through an arc to an open position, in which the outer upright is spaced from the inner upright and the connecting rungs are horizontal. Still more particularly, this invention relates to a releasable locking means holding the ladder in a closed position and releasable by the hand or foot of the user to allow the outer upright to swing through an arc under the influence of gravity until the ladder is in the open position. Still more particularly, this invention relates to a lightweight collapsible ladder which is adapted to be secured in a series to the wall of a structure so that a user may open each ladder in sequence and descend them, one after the other, until he reaches safety.

It is an overall object of this invention to provide a lightweight collapsible ladder which will provide easy, safe and swift exit from a structure in case of fire or other emergency. It is a further object of the invention to provide a collapsible ladder which can be mounted on either the left or right side of a window or other structure opening. It is another object of the invention to provide an escape ladder which is closed during periods of nonuse to prevent unauthorized use and to prevent burglary. Still another object of the invention is to provide a ladder which requires little space and is aesthetically pleasing during periods of nonuse. It is a still further object of the invention to provide a ladder which will be very durable and maintenance free. It is also an object of the invention to provide a ladder which is adapted to be used in a vertically arranged series of ladders to permit escape from a structure of any height.

BRIEF SUMMARY OF THE INVENTION

Directed to achieving the aforementioned objects and providing a collapsible escape ladder like that described, this invention relates to a ladder having lightweight members which are pivotally connected to one another. The uprights comprise elongated channel members which are parallel and which are connected to one another by a plurality of pivotally mounted connecting rungs. The rungs are connected at their ends to the uprights by pin means.

Support means are provided at various locations along the length of the ladder to hold the ladder in its open position, wherein the rungs are horizontal. Each support means includes a brace member pivotally connected at one end to an upright by one of the aforementioned pin means and pivotally connected at its other end to a depending lug on a sleeve mounted for sliding on a rung. The brace member is connected to an upright by a pin means that also connects one end of a rung to the upright, and the sleeve is mounted on a rung which is positioned above the first-mentioned rung. The extent of travel of the slideable sleeve and, consequently, the extent of the swinging of the outer upright are limited by the engagement of the sleeve with a spacer means carried by the pin means.

Locking means is provided at the top of the ladder to hold the ladder in its closed position, with the uprights abutting one another. The locking means comprises a latch on one upright which engages a locking member secured to the other upright.

The rungs are secured to the uprights in two adjacent vertical planes, every other rung being in one vertical plane and alternate rungs being in the other vertical plane. This arrangement provides the ladder with greater lateral stability without the use of external braces.

A plurality of ladders according to the invention may be secured to the wall of a structure in a vertical series in which each ladder is above and adjacent to the ladder below it. By such an arrangement, a user may release the locking means of one ladder, causing it to open, descend the ladder until he reaches the ladder below it, release the locking means of that ladder and repeat the procedure until he reaches the ground.

DETAILED DESCRIPTION OF THE PREFERRED EMBODIMENT

Figure 1:
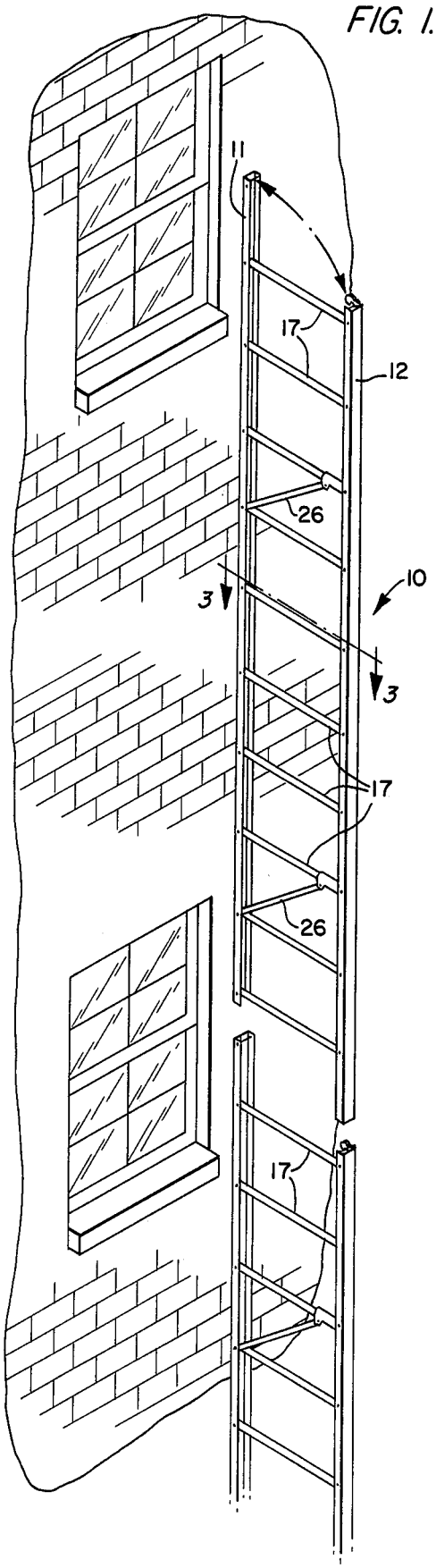
FIG. 1 is a perspective view of a series of the ladders, in their open position, embodying the principles of the present invention.
Figure 2:
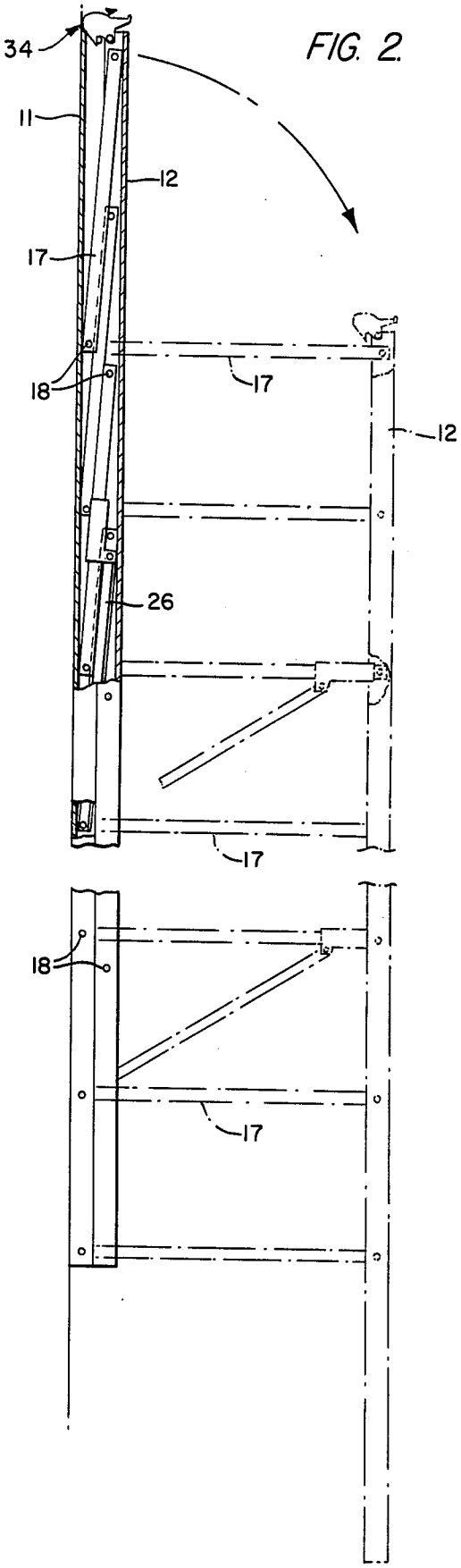
FIG. 2 is an elevational view of the ladder according to the present invention in its closed position, showing portions of the uprights cut away and the open position of the ladder in phantom.

The ladder according to the invention is designated generally by the reference numeral 10. As shown in FIG. 1, the ladder 10 includes an inner upright 11 and an outer upright 12 which is parallel to the inner upright 11. The uprights 11 and 12 preferably comprise channel members which are generally U-shaped in cross-section, having an open side and a plurality of closed sides 14, 15 and 16. The channel members are also open at their ends to allow the passage of water and foreign material, especially when the ladder is in its closed position. The open sides of the channel members comprising the inner and outer uprights 11 and 12, respectively, face each other. The uprights 11 and 12 are connected to one another by a plurality of parallel rungs 17. Each of the rungs 17 comprises an elongated integral member pivotally mounted at one end to the inner upright and pivotally mounted at the other end to the outer upright. As used herein, the word integral means having no parts which are movable relative to one another. The ends of the rungs 17 extend into the channels of the uprights 11 and 12 and are pivotally secured therein by pin means 18 which extend through the side walls 14 and 15 of the uprights 11 and 12. The pin means 18 preferably comprise a male screw member 12 and a complementary female screw member 20.

The depth of each rung 17 is approximately one-half the width of the channels of the uprights 11 and 12. Each of the rungs 17 is held against one of the sides 14 or 15 of the channels by spacer means 21 which may be in the form of a bushing received on each pin means 18. The dimension of the spacer means 21 in the direction along the axis of the pin means 18 is approximately equal to one-half the width of the channel. The spacer means 21 is positioned on the pin means 18 between the rung 17 and one of the sides of the channel and, thus, holds the rung 17 against another side of the channel. A washer 22 is provided on each pin means 18, between the associated rung 17 and the side of the channel against which the rung is held.

Alternate ones of the rungs 17 are held against opposite sides of the channels. Thus, the top rung, the third rung from the top, the fifth rung from the top, etc. are held against one side 14 of the channel and the second, fourth, sixth, etc. rungs are held against the other side 15 of the channel. This arrangement provides greater lateral stability of the ladder without the use of any external braces.

As can best be seen from FIG. 1, support means 26 for supporting the ladder in an open position are provided. The support means 26 comprise an elongated brace member 28 and a slidable sleeve 30 having a depending lug 32. The brace member 28 is pivotally connected at one end to the inner upright 11 by one of the pin means 18. The other end of the brace member 28 is pivotally connected to the depending lug 32 by a pin 33. The brace member 28 is connected to the inner upright 11 by a pin means 18 that also connects one end of a rung 17 to the upright 11, and the sleeve 30 is mounted on a rung 17 which is positioned above the first-mentioned rung 17. The travel of sleeve 30 on its rung 17 and, consequently, the movement of outer upright 12 through its arc are limited by the engagement of the sleeve 30 with the spacer means 21 associated with the end of the rung 17 adjacent to the outer upright 12.

A plurality of brace means 26 can be spaced from top to bottom along a single ladder. For example, one brace means can be placed at the top of the ladder, one at the bottom and one in the middle.

Figure 3:
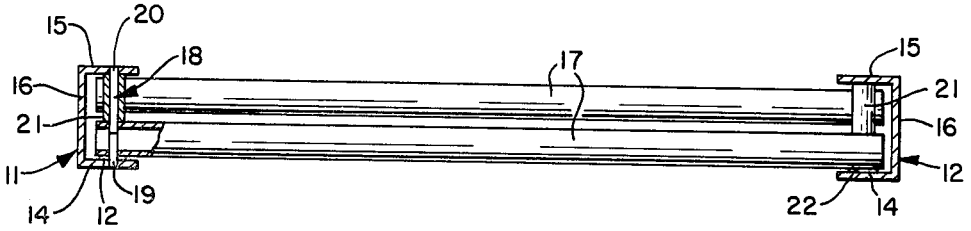
FIG. 3 is a cross-sectional view, taken along line 3—3, of the ladder as shown in FIG. 1.
Figure 4:
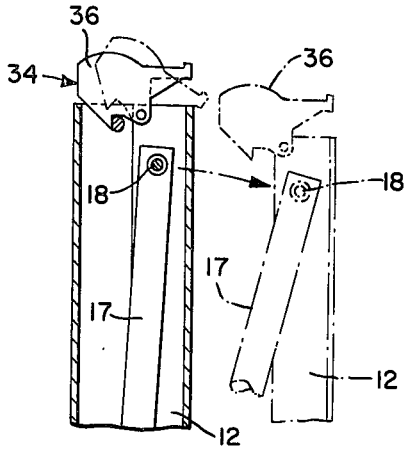
FIG. 4 is an enlarged fragmentary elevational view of the top of the ladder in its closed position, illustrating the operation of the latch and showing an intermediate position of the outer upright in phantom.
Figure 5:
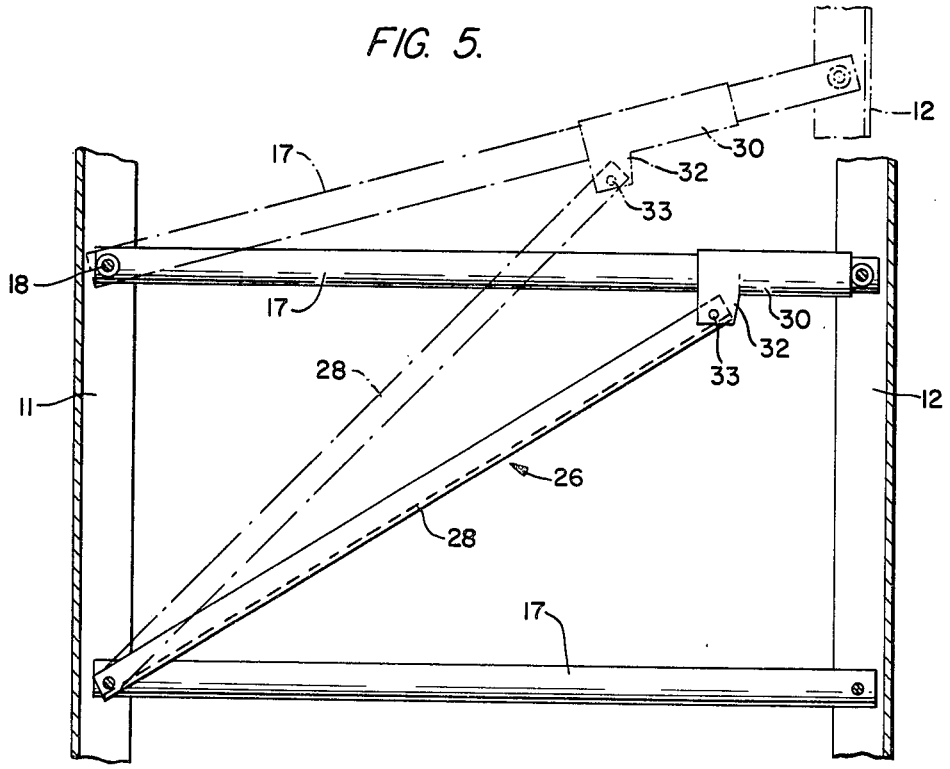
FIG. 5 is an enlarged fragmentary elevational view of the ladder, illustrating the brace means and showing an intermediate position of the brace means.

As best shown in FIGS. 1 and 3, locking means 34 are provided for locking the ladder in the closed or collapsed position. The locking means 34 includes a latch 36 pivotally connected to the top of one of the uprights and a locking member 38 connected to the top of the other of the uprights. The member 38 can be one of the two-piece pin means 19, which has been machined flat on a side facing away from the latch 36. The locking means 34 is located at the top of the uprights so that the ladder cannot be opened from the ground or from a lower floor. This feature prevents unauthorized use of the ladder and potential burglaries. In the closed or collapsed position, the ladder 10 appears to be a rectangular tubular member much like a rain gutter down spout. As such, it is neither visually obtrusive nor aesthetically offensive.

All of the parts of the ladder may be made from aluminum, except the pin means 18, which are preferably made from stainless steel.

The inner upright 11 is fastened to the structure by bolts or other suitable fastening means. In the closed position, the ladder is approximately 4 inches square and 10 feet long. It is installed vertically next to a window or other opening about six inches away from the edge of the opening. The top of the ladder extends about 24 inches above the sill of the opening and provides a grip area, and the rest of the ladder extends about 8 feet below the sill. The ladder is suitable to be installed on either the left or right side of any opening. The rungs are spaced about 12 inches center-to-center for easy use by children and as an additional grip for the elderly.

In use, the ladder is opened by downward pressure on the latch 36. This releases the outer rail 12, which will be swung by gravity outwardly and downwardly in an arc from the inner rail 11 until the slidable sleeves 30 of the support means 26 engage their respective spacer means 21. This will occur when the rungs 17 are in a horizontal position.

For escape from a second floor level, one ladder is sufficient to reach the ground. For escape from higher levels, a series of ladders may be installed one above the other on a structure. The user descends the top ladder until he reaches the bottom rung, whereupon he extends one foot downwardly until it engages the latch 36 of the next ladder in the series, which releases that ladder, so that it opens for his use. This procedure can be repeated until the user reaches the ground.

The invention may be embodied in other specific forms without departing from its spirit or essential characteristics. The present embodiments are, therefore, to be considered as illustrative and not restrictive, the scope of the invention being indicated by the claims rather than by the foregoing description, and all changes which come within the meaning and range of the equivalents of the claims are therefore intended to be embraced therein.

What is claimed is:

1. A collapsible ladder for providing escape from a structure, comprising an inner upright adjacent to the structure and an outer upright connected to the inner upright by a plurality of rungs, each of said rungs comprising an elongated integral member which is pivotally mounted at one end to said inner upright and is pivotally mounted at the other end to said outer upright, whereby the ladder is movable from a closed position in which the outer upright abuts the inner upright to an open position in which the outer upright is spaced from the inner upright and the rungs are horizontal, and support means for supporting the ladder in the open position, said support means including an elongated brace member and a sleeve slidably mounted on one of said rungs, said brace being pivotally mounted at one end to one of said uprights and being pivotally mounted at its other end to said sleeve.

2. The ladder according to claim 1 further including means for locking the ladder in the closed position.

3. The ladder according to claim 2 wherein the locking means is located at the top of the ladder.

4. The ladder according to claim 3 wherein the locking means comprises a latch mounted on one of the uprights and a locking member secured to the other of said uprights for engagement with the latch.

5. The ladder according to claim 1 wherein said rungs are pivotally mounted at their ends to said uprights by a plurality of pin means.

6. The ladder according to claim 5 wherein the travel of said sleeve on said one rung and the movement of the ladder to said open position are limited by engagement of said sleeve with spacer means mounted on one of said pin means.

7. The ladder according to claim 1 wherein the rungs are arranged in two adjacent vertical planes, every other of said rungs being positioned in one of said planes and alternate ones of said rungs being positioned in the other of said planes to provide greater lateral stability.

8. The ladder according to claim 7 wherein each said upright comprises a channel member having an open side and a plurality of closed sides, the open sides facing one another and the ends of said rungs being received in said channel members and pivotally connected thereto by a plurality of pin means, spacer means being mounted on said pin means for holding said rungs against one of said closed sides.

9. The ladder according to claim 8 wherein each said rung has a depth equal to approximately one-half of the width of the channel of the channel member.

10. Apparatus for providing escape from a structure comprising a plurality of ladders secured to a structure, each said ladder being above and adjacent to the ladder below to form a vertical series, wherein each said ladder comprises an inner upright adjacent to the structure and an outer upright connected to the inner upright by a plurality of rungs, each of said rungs comprising an elongated integral member which is pivotally mounted at one end to said inner upright and is pivotally mounted at the other end to said outer upright, whereby the ladder is movable from a closed position in which the outer upright abuts the inner upright to an open position in which the outer upright is spaced from the inner upright and the rungs are horizontal, and support means for supporting the ladder in the open position, said support means including an elongated brace member and a sleeve slidably mounted on one of said rungs, said brace being pivotally mounted at one end of said uprights and being pivotally mounted at its other end to said sleeve.

11. The apparatus according to claim 10 including locking means positioned at the top extremity of each said ladder to retain said ladder in the closed position, said latching means being releasable by the downward pressure of a user supported on the ladder above, whereby a user can descend each ladder, release the locking means of the next ladder below so that it will move to the open position, descend said next ladder, and repeat this procedure until he reaches safety.

12. The apparatus according to claim 11 wherein the locking means comprises a latch connected to the top of one of said uprights and a locking member connected to the top of the other of said uprights for engagement with the latch.

* * * * *